US007231910B2

(12) United States Patent
Wagner

(10) Patent No.: US 7,231,910 B2
(45) Date of Patent: Jun. 19, 2007

(54) METHOD FOR SETTING THE FEED RATE OF A FUEL PUMP UNIT, WHICH SUCKS UP FUEL FROM A FUEL TANK, AND FUEL PUMP UNIT FOR THE METHOD

(75) Inventor: Gunter Wagner, Wolfhagen (DE)

(73) Assignee: Siemens Aktiengesellschaft, Munich (DE)

( * ) Notice: Subject to any disclaimer, the term of this patent is extended or adjusted under 35 U.S.C. 154(b) by 213 days.

(21) Appl. No.: 11/034,301

(22) Filed: Jan. 12, 2005

(65) Prior Publication Data

US 2005/0158180 A1 Jul. 21, 2005

(30) Foreign Application Priority Data

Jan. 16, 2004 (DE) ..... 10 2004 002 459

(51) Int. Cl.
*F02M 37/04* (2006.01)

(52) U.S. Cl. ..... 123/497; 123/179.17; 417/62; 417/244

(58) Field of Classification Search ..... 123/446, 123/497, 179.17; 417/3, 4, 62, 244, 246, 417/247, 279
See application file for complete search history.

(56) References Cited

U.S. PATENT DOCUMENTS 4,718,827 A * 1/1988 Sutton et al. ..... 417/244
4,789,308 A * 12/1988 Tuckey ..... 417/44.8
5,435,691 A * 7/1995 Braun et al. ..... 415/55.6
5,775,304 A * 7/1998 Kono et al. ..... 123/497
6,196,806 B1 * 3/2001 Van Der Sluis ..... 417/62
2002/0187051 A1 * 12/2002 Maier et al. ..... 417/203
2004/0208753 A1 * 10/2004 Mori ..... 417/244

FOREIGN PATENT DOCUMENTS

DE 199 02 427 C1 8/2000
DE 100 05 589 A1 8/2001
EP 1 065 383 A1 6/2000
JP 2002339823 A 11/2002

* cited by examiner

*Primary Examiner*—Carl S. Miller
(74) *Attorney, Agent, or Firm*—Mayer, Brown, Rowe & Maw LLP

(57) ABSTRACT

The invention relates to a method for setting the feed rate of a fuel pump unit, which sucks up fuel from a fuel tank 8, as a function of the feed pressure, which is built up by the fuel pump unit, in an outlet 25 of the fuel pump unit, which outlet leads to an internal combustion engine. The fuel pump unit has a first pump stage and a second pump stage, the two pump stages being connected in parallel below a defined feed pressure in the outlet 25 of the fuel pump unit and being connected in series above the defined feed pressure.

5 Claims, 1 Drawing Sheet

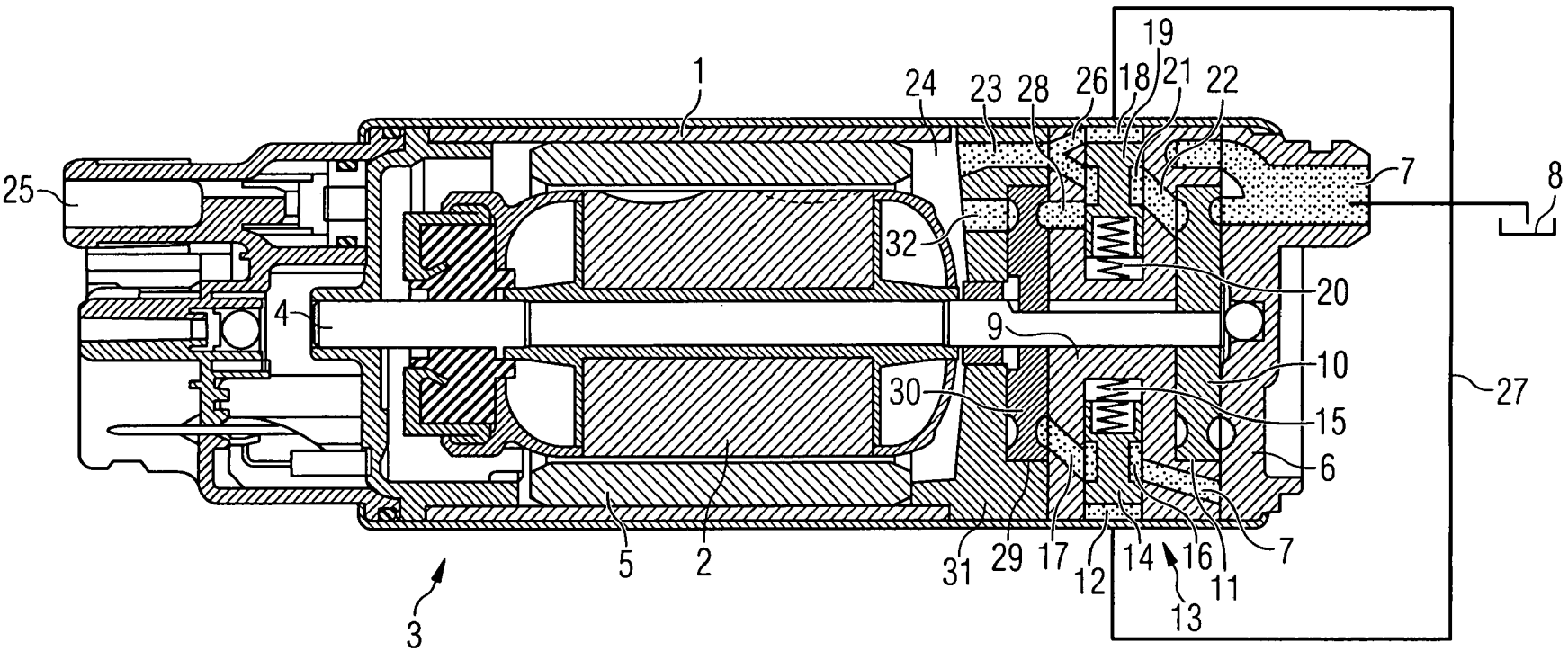
8
27
7
20
10
15
6
7
22
11
16
13
19
21
18
14
26
12
28
17
23
9
29
31
24
32
30
1
2
5
3
4
25

METHOD FOR SETTING THE FEED RATE OF A FUEL PUMP UNIT, WHICH SUCKS UP FUEL FROM A FUEL TANK, AND FUEL PUMP UNIT FOR THE METHOD

BACKGROUND OF THE INVENTION

The invention relates to a method for setting the feed rate of a fuel pump unit, which sucks up fuel from a fuel tank, as a function of the feed pressure, which is built up by the fuel pump unit, in an outlet of the fuel pump unit, which outlet leads to an internal combustion engine, and to a fuel pump unit for this method.

In the case of a known method of this type, the fuel pump is activated as a function of operating parameters of the internal combustion engine by appropriately setting the speed of rotation of the fuel pump. In this case, the pressure which is built up by the fuel pump is limited to a defined, specified pressure by means of a pressure-limiting element. For this purpose, the speed of rotation of the fuel pump, the temperature and the suction pressure at the throttle valve of the internal combustion engine and fuel composition data are detected as operating parameters by means of sensors and are evaluated in an evaluation unit. The latter then correspondingly produces a pulsed control voltage for activating the fuel pump.

A very great and complicated outlay is required for detecting the operating parameters and for generating the activating voltage.

It is therefore the object of the invention to provide a method for setting the feed rate of a fuel pump unit, which sucks up fuel from a fuel tank, and a fuel pump unit for this method, which make it possible, in a simple manner and with little outlay, to set the fuel feed rate in accordance with the particular fuel requirement of the internal combustion engine.

BRIEF DESCRIPTION OF THE INVENTION

This object is achieved with regard to the method by the fact that the fuel pump unit has a first pump stage and a second pump stage, the two pump stages being connected in parallel below a defined feed pressure in the outlet of the fuel pump unit and being connected in series above the defined feed pressure.

With regard to the fuel pump unit, the object is achieved in that the first pump stage has a suction connection connected to a fuel tank and a delivery connection, and in that the second pump stage has a suction connection and a delivery connection leading to the outlet of the fuel pump unit, and having a two-way directional control valve by means of which, in a first switching position, the delivery connection of the first pump stage is connected to the outlet of the fuel pump unit and the suction connection of the second pump stage is connected to the fuel tank, and by means of the two-way directional control valve, in its second switching position, the delivery connection of the first pump stage is connected to the suction connection of the second pump stage.

This design does not require any sensors nor an electronic evaluating unit in order to regulate the fuel pump; rather, it regulates the fuel feed rate exclusively via mechanical components. This fuel pump unit is therefore not only cost-effective but also has a very low susceptibility to failure.

Since only the fuel quantity required in each case by the internal combustion engine is delivered, both electric energy for driving the fuel pump unit and fuel are saved and therefore harmful emissions are reduced. In addition, the structure-borne sound of the first pump stage is also reduced.

The necessary volumetric flow for idling and for the average part-load range of the internal combustion engine is realized by the series connection of the two pump stages. As a result of the fact that the second pump stage does not then produce any pressure, the torque necessary at the motor and thus also the electric current consumption are reduced.

If the fuel quantity of the first stage now no longer suffices, for example in the case of an accelerating process of the vehicle, the two pump stages are connected in parallel.

The two-way directional control valve may be a solenoid valve which can be activated as a function of the feed pressure in the outlet of the fuel pump unit.

In this case, the feed pressure in the outlet of the fuel pump unit can be detected by a pressure sensor, and a corresponding activating signal can be produced, by means of which the solenoid valve can be acted upon and can be placed into its first switching position or second switching position.

The fuel pump unit is designed completely mechanically and is thus not susceptible to failure if the two-way directional control valve has a first control slide valve and a second control slide valve which can be acted upon by the pressure in the outlet of the fuel pump unit in a manner such that they can be moved, in each case counter to the force of a control spring, from their first switching position into their second switching position.

A simple construction is achieved here by the fact that the control slide valves are of cylindrical design and are arranged displaceably in each case in a corresponding slide-valve bore in a housing part of the fuel pump unit and have a radially encircling control groove on their cylindrical circumferential surface, in the first switching position the delivery connection of the first pump stage being connected via the second control groove of the second control slide valve to the outlet of the fuel pump unit and a first suction connection of the second pump stage being connected via the first control groove of the first control slide valve to the suction connection leading to the fuel tank, and in the second switching position the delivery connection of the first pump stage being connected via the second control groove to a second suction connection of the second pump stage and the first suction connection of the second pump stage being shut off by the first control slide valve from the suction connection leading to the fuel tank.

A delivery with a low energy requirement is produced if the first pump stage and/or the second pump stage is a flow pump, the flow pump preferably being a side channel pump or a peripheral impeller pump.

A small overall size and a reduction in the number of components are achieved by the fact that the pump impellers of the flow pumps are arranged on a common drive shaft and can be driven rotatably by a common drive motor.

In this case, likewise in a manner saving on construction space, a partition which contains the two-way directional control valve may be arranged between the pump impeller of the first pump stage and the pump impeller of the second pump stage.

BRIEF DESCRIPTION OF THE DRAWING

An exemplary embodiment of the invention is illustrated in the drawing and is described in greater detail below. The single FIGURE of the drawing shows a fuel pump unit in cross section.

DETAILED DESCRIPTION OF THE INVENTION

The fuel pump unit illustrated has a tube-like pump housing 1 in which a rotor 2 of an electric drive motor 3 is mounted rotatably by means of a drive shaft 4. The rotor 2 is surrounded by a stator 5.

At its one end region, the pump housing I is closed by a closing plate 6 which has a suction connection 7 which is connected to a fuel tank 8. By means of its surface facing the housing interior, the closing plate 6 forms a side wall of a pump chamber 11 of a first side channel pump forming a first pump stage.

Arranged in this pump chamber 11, which is designed as a cup-shaped depression in a partition 9 and is bounded axially on its other side by the bottom of the cup-shaped depression of the partition 9, is a pump impeller 10 of the first side channel pump, which pump impeller sits in a rotationally fixed manner on the drive shaft 4 protruding into the pump chamber 11.

The suction connection 7 leads both to the pump chamber 11 of the first pump stage and to a first slide-valve bore 12 of a two-way directional control valve 13, which slide-valve bore is formed in the partition 9. A first control slide valve 14 is arranged displaceably in this slide-valve bore 12 and can be pressurized, on its radially outer end surface, counter to the force of a first control spring 15 in a manner such that it can be displaced from an open position into a closed position.

In the open position, the suction connection 7 is connected via a first control groove 16 to a first suction connection 17 of a second pump stage. In this case, the control groove 16 is formed in a radially encircling manner in the cylindrical circumferential surface of the first control slide valve 14.

In a second slide-valve bore 18 of the two-way directional control valve 13 in the partition 9, the one end surface of a second control slide valve 19 can be acted upon by the same pressure as the first control slide valve 14 in a manner such that it can be displaced, counter to a second control spring 20, from a first position into a second position.

For this purpose, the second control slide valve 19 likewise has a second control groove 21 which is formed in a radially encircling manner on its cylindrical circumferential surface and via which, in the open position, a delivery connection 22 of the first pump stage is connected to a connecting passage 23 which leads to the motor compartment 24, which contains the drive motor 3, of the pump housing 1 from which an outlet 25 leads to the outside and can be connected to an internal combustion engine.

The motor compartment 24 is permanently connected via connecting lines 26 and 27 to the first slide-valve bore 12 and the second slide-valve bore 18 for the pressurization of the first control slide valve 14 and of the second control slide valve 19, so that the control slide valves 14 and 19 are always acted upon by the pressure prevailing in the motor compartment.

In the illustrated first position of the second control slide valve 19, the delivery connection 22 of the first pump stage is connected to the motor compartment 24 while, in the second position of the second control slide valve 19, the delivery connection 22 of the first pump stage is connected to a second suction connection 28 of the second pump stage.

The second pump stage likewise comprises a side channel pump having a second pump impeller 30, which is arranged in a pump chamber 29 and is arranged, likewise in a rotationally fixed manner, on the drive shaft 4 protruding through the second pump chamber 29.

The second pump chamber 29 is designed as a cup-shaped depression in a second partition 31, which delimits the motor compartment 24 from the pump stages, the bottom of the cup-shaped depression bounding the second pump chamber 29 axially to the one side and the partition 9 axially to the other side. A delivery connection 32 leads from the second pump chamber 29 into the motor compartment 24.

When the internal combustion engine is at a standstill, the fuel pump unit is also at a standstill, a reduced pressure prevailing in the fuel system and the control slide valves 14 and 19 being kept in their radially outer position illustrated by means of the control springs 15 and 20.

In this case, the delivery connection 22 of the first pump stage is connected directly to the motor compartment 24 and the first suction connection 17 of the second pump stage is connected to the suction connection 7 of the fuel pump unit.

The two pump stages are therefore connected in parallel and both, when driven in rotation by the drive motor 3, deliver at a maximum feed rate into the motor compartment 24. The fuel flows through the latter, simultaneously cooling the drive motor 3, and is delivered via the outlet 25 to the internal combustion engine.

If, in this switching position of the two-way directional control valve 13, a higher volumetric flow is produced than the internal combustion engine requires, the pressure rises in the fuel system and therefore in the motor compartment 24. This pressure then acts on the two control slide valves 12 and 19 in such a manner that the latter are displaced counter to the force of the control springs 15 and 20, so that the delivery connection 22 of the first pump stage is now connected to the suction connection 28 of the second pump stage and the further suction connection 17 of the second pump stage is shut off. The two pump stages are therefore connected in series, as a result of which the feed rate of the fuel pump unit is reduced.

If this reduced feed rate then becomes too small, for example in the case of acceleration processes, the system pressure also drops in the motor compartment 24. This means that the forces of the control springs 15 and 20 are greater than the compressive forces acting on the control slide valves 14 and 19, so that the control slide valves 14 and 19 are again pushed radially outward, and the two pump stages are again connected in parallel and therefore delivery takes place again at the maximum feed rate.

The invention claimed is:

1. A fuel pump unit having first and second pump stages characterized in that the first pump stage has a suction connection (7) connected to a fuel tank (8) and a delivery connection (22), and in that the second pump stage has a suction connection (17, 28) and a delivery connection (32) leading to the outlet (25) of the fuel pump unit, and having a two-way directional control valve (13) by means of which, in a first switching position, the delivery connection (22) of the first pump stage is connected to the outlet (25) of the fuel pump unit and the suction connection (17) of the second pump stage is connected to the fuel tank (8), and by means of the two-way directional control valve (13), in its second switching position, the delivery connection of the first pump stage is connected to the suction connection (28) of the second pump stage and in that the two-way directional control valve (13) has a first control slide valve (14) and a second control slide valve (19) which can be acted upon by the pressure in an outlet (25) of the fuel pump unit in a manner such that they can be moved, in each case counter to the force of a control spring (15, 20), from their first switching position into their second switching position.

2. The fuel pump unit as defined in claim 1, characterized in that the first pump stage and/or the second pump stage is a flow pump.

3. The fuel pump unit as defined in claim 2, characterized in that the flow pump is a side channel pump or a peripheral impeller pump.

4. The fuel pump unit as defined in claim 3, characterized in that the pump impellers (10, 30) of the flow pumps are arranged on a common drive shaft (4) and can be driven rotatably by a common drive motor (3).

5. The fuel pump unit as defined in claim 4, characterized in that a partition (9) which contains the two-way directional control valve (13) is arranged between the pump impeller (10) of the first pump stage and the pump impeller (30) of the second pump stage.

* * * * *